United States Patent [19]

Yamada et al.

[11] Patent Number: 4,880,041

[45] Date of Patent: Nov. 14, 1989

[54] APPARATUS FOR FLOWING AND FILLING LIQUIFIED INERT GAS

[75] Inventors: Morio Yamada; Yoshihiko Kimura, both of Yokohama, Japan

[73] Assignee: Tokyo Seikan Kaisha, Ltd., Tokyo, Japan

[21] Appl. No.: 177,267

[22] Filed: Apr. 4, 1988

[30] Foreign Application Priority Data

Apr. 15, 1987 [JP] Japan ..... 62-90643
Apr. 23, 1987 [JP] Japan ..... 62-98738

[51] Int. Cl.[4] ..... B65B 31/00

[52] U.S. Cl. ..... 141/167; 53/431; 62/52.1; 141/82; 141/103; 141/83

[58] Field of Search ..... 141/4, 5, 9, 11, 83, 141/69, 70, 82, 129, 153, 163, 167, 177, 103; 62/50, 51, 55, 49; 53/431, 432, 111 R

[56] References Cited

U.S. PATENT DOCUMENTS 4,206,788 6/1980 Susaki et al. ..... 141/167 X
4,407,340 10/1983 Jensen et al. ..... 141/82 X
4,489,767 12/1984 Yamada ..... 141/82 X
4,514,953 5/1985 Patzwahl ..... 141/167 X

FOREIGN PATENT DOCUMENTS 58-146797 9/1983 Japan .
58-166196 10/1983 Japan .
6150200 11/1986 Japan .

*Primary Examiner*—Ernest G. Cusick
*Attorney, Agent, or Firm*—Armstrong, Nikaido Marmelstein, Kubovcik & Murray

[57] ABSTRACT

An apparatus for flowing and filling liquified gases, which fuctions to flow and to fill liquified bases into cans from a liquified gas storage tank immediately before seaming of the cans. The apparatus includes a solenoid for attracting an upper portion of a needle of a flow valve formed from a needle valve to open and clode the valve. A pulse motor adjusts an opening-degree of the valve. A valve opening-degree detecting device detects the opening degree. A direction changing nozzle is formed with a nozzle opening obliquely descended in a direction of transporting a can, below the flow valve. A line speed and a balve open amount in a high speed region and a low speed region are respectively set to thereby obtain a line speed/valve opening-degree conversion table, on the basis of which an opening-degree of the valve can be controlled following the line speed.

2 Claims, 5 Drawing Sheets

APPARATUS FOR FLOWING AND FILLING LIQUIFIED INERT GAS

BACKGROUND OF THE INVENTION

1. Field of the Invention

This invention relates to an apparatus for flowing and filling liquefied inert gas. The apparatus functions to flow and to fill a liquefied inert gas, such as a liquid nitrogen, immediately before seaming of a can in order to apply internal pressure to the can.

2. Description of the Prior Art

In the past, for obtaining an internal pressure of a can formed of a soft material, a liquefied inert gas (hereinafter merely referred to as the liquefied gas) such as liquid nitrogen has been filled into a head space of a can filled with liquid immediately before seaming of the can. The internal pressure of the can varies with a difference of a filling amount of the liquefied gas such that if the filling amount is small, the internal pressure is insufficient resulting in an insufficient strength of the can. Conversely, if the filling amount is large, over-pressure results. It has been therefore required that the filling amount is always controlled to a proper value according to the seaming condition and the like.

In the past, filling of the liquefied gas into a can in a high-speed canning line has been carried out in such a manner that the liquefied gas is continuously made to flow into cans continuously conveyed by a conveyor from a liquefied gas storage tank. The filling amount is controlled by changing an opening degree of a valve. As for the method for controlling the filling amount, a method has been proposed in which an opening degree of a valve is controlled to follow the line speed (for example, Japanese Patent Application Laid-Open Nos. 146797/1983 and 166196/1983).

In the flow-amount control devices heretofore proposed, a valve rod of a needle valve is always urged by a spring in a direction of opening the valve (upward). An upper end of the valve rod is defined by a drive rod moved up and down by means of a pinion rack mechanism or an electrically-driven cylinder. The drive rod is displaced according to the line speed to thereby control the opening of the valve at the same time when the valve is opened. The opening degree of the valve with respect to the line speed is obtained by inputting into a microprocessor in advance, a conversion table which has calculated, using internal pressure of a can as a parameter, the relationship between the line speed and the flow amount of liquid nitrogen required to obtain a fixed internal pressure, and effecting arithmetic operation on the basis of the conversion table corresponding to the detection valve of the line speed. The liquefied gases from the valve, which are filled into the cans, are stored in a sintered metal container to de-energize them. Scattering of the liquefied gases outside the can is prevented to improve the yield of the liquefied gases into the can.

However, in the above-described conventional apparatus, even if the opening degree of the valve is varied to follow the speed of the line, if a flow of liquid is received by a porous container a problem arises in that the response is so slow as to make it difficult to properly control the flow amount of the liquefied gases to follow the line speed.

Furthermore, in the above-described conventional apparatus, since the control for the opening and closing of the valve and the control of the opening degree are carried out by one and the same means, it is difficult to control the opening degree of the valve properly particularly in the early stage of operation. That is, at the start of operation of a seamer, normally, rolling of a can starts after idle operation. Therefore, in the case of a high-speed operation, cans are abruptly conveyed to the flow-down position. Thus, the opening degree of the valve needs to be set while comparing the operation of opening the valve, the opening degree of the valve during the opening and the value of the opening degree of the valve obtained by the arithmetic operation from the line speed. Therefore, the control of the opening degree of the valve is late, failing to obtain an accurate opening degree of the valve. As a result, cans can be produced which are defective in internal pressure in the early stages of the operation. In the above-described prior art, the flow amount is controlled on the basis of the specific conversion table of the line speed/the open amount of valve set for high speed and for low speed. However, the proper amount of the liquefied gases filled into the cans differs with various conditions such as the amount of the contents , filling conditions therefore, and the like. It has been difficult to obtain a proper filling amount corresponding to the change in all these conditions merely by using a specific conversion table.

On the other hand, an arrangement it has been proposed wherein a device for opening and closing a flow valve and a device for controlling an opening degree of a valve are independently organized. In order to closely control the flow amount corresponding to the change in various conditions such as a filling condition for cans, a seaming condition and the like, the inclination and offset thereof are selected corresponding to the change in the conditions to obtain an optimum conversion table which meets the conditions. The flow amount is controlled on the basis thereof to thereby overcome the problems noted above (Japanese Patent Publication No. 50200/1986). In this case, selection of the speed/opening degree conversion table according to the conditions is carried out by two units, i.e., a gain setting unit for determining an inclination and an offset setting unit for moving the table in parallel. Therefore, for example, in the case where a conversion table with only an opening degree at a low speed changed is desired to be obtained, the inclination is first changed by the gain setting unit, and two setting units had to be changed. Further, to insure whether the set is correct or not, it has been necessary to switch the low-speed operation and high speed operation to confirm an opening degree. Moreover, when a flow of liquefied gases flowing from the flow valve is directly introduced into cans, scattering increases. When a porous receiving container is provided halfway in the flow in order to overcome such a scattering, there poses a problem in that the response to the line speed is deteriorated.

SUMMARY OF THE INVENTION

It is an object of the present invention to provide an apparatus for flowing and filling liquefied gases, which can accurately control a flow amount of liquefied gases into a can in order to obtain a fixed internal pressure within the can according to a line speed. The apparatus can obtain a high speed response of a flow valve with respect to a variation in line speed even at the start of flow and at the stop of flow.

It is a further object of the present invention to provide an apparatus for flowing and filling liquefied gases, which can guide a flow of liquid flowing from a flow valve to a liquid level, relieving a shock when the flow of liquid reaches the liquid level within the can without impairing the response to the line speed, to fill the liquefied gases with good yield.

It is another object of the present invention to provide an apparatus for flowing and filling liquefied gases which can easily and positively change a speed/opening degree conversion table corresponding to the change in conditions.

For achieving the above-described objects, the present invention provides an apparatus for flowing and filling liquefied gases, which functions to flow and fill the liquefied gases within a liquefied gas storage tank into a can immediately before seaming of the can. A flow valve is in the form of a needle valve. The valve is controlled by a solenoid for attracting an upper portion of a needle to open and close the flow valve. A pulse motor adjusts an opening degree of the flow valve. A valve opening-degree detection device detects an opening degree of the flow valve. A direction change nozzle, formed with a nozzle orifice obliquely descended in a direction of transporting the can, is provided below the flow valve to impart a speed component in a direction of transporting a can to a flow of liquefied gases flowing from a storage tank, thus preventing scattering of liquefied gases outside the can.

The apparatus further comprises a line speed detector for detecting a line speed, a speed setting unit and a valve opening-degree setting unit for a high speed region and a low speed region. The valve opening-degree setting unit sets a line speed/valve opening-degree conversion table with respect to the line speed. A device is provided for arithmetically operating an opening degree of a valve by a line speed detection value on the basis of the conversion table. Also provided is a device for comparing the arithmetically operated value with the valve opening-degree detection value. The opening degree of the valve can be controlled to follow the change in speed of the line, and the relationship between the line speed and the valve opening degree can be easily changed according to the change in the filling condition.

In the apparatus of the present invention constructed as described above, according to the speed/opening degree conversion table for converting the line speed into the valve opening degree, if a speed in a high speed region and an opening degree at that time, and a speed in a low speed region and an opening degree at that time are set as shown in FIG. 4(*a*), a speed/opening-degree conversion graph is obtained and a speed/opening-degree conversion table as desired can be prepared. For example, for changing only the opening degree at the low speed, a conversion table as desired can be simply obtained merely by changing the set value of a low speed opening-degree setting unit as shown in FIG. 4(*b*). The opening degree of the valve is controlled following the line speed on the basis of the thus set conversion table. The opening degree of the valve is arithmetically operated from the line speed detection valve whereby the valve opending-degree adjusting device is controlled independently of the valve opening and closing device. Accordingly, at the beginning of operation, the valve opening-degree adjusting device is controlled to follow the line speed simultaneously with the start of operation. When a can is then detected by a can detector, the valve opening and closing device actuates to open the valve. Since at that time, the valve opening-degree adjusting device is adjusted to a fixed position according to the speed, a proper opening degree of a valve is obtained at the start of operation. The flow of liquefied gases from the flow valve is applied with a speed component in a direction of transporting a can by a direction changing nozzle, whereby a shock produced when reaching a liquid level in the can is relieved, scattering outside the can is prevented and an amount of liquefied gases proportional to an open amount of the valve is filled.

DETAILED DESCRIPTION OF THE PREFERRED EMBODIMENT

Figure 1:
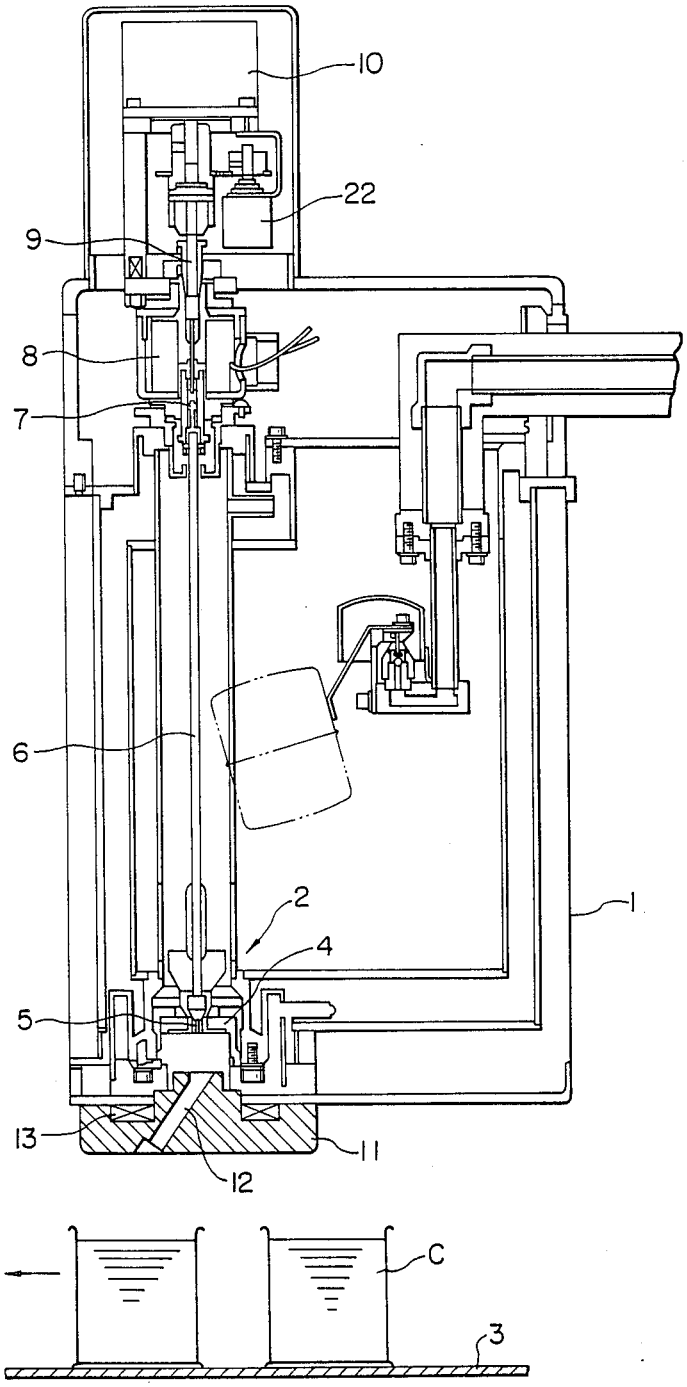
FIG. 1 is a front sectional view of an embodiment of an apparatus for flowing liquefied gases according to the present invention.

FIG. 1 shows one example of an apparatus for flowing liquefied gases to which the present invention is applied. In FIG. 1, reference numeral 1 designates a body of a liquefied gas storage tank. The liquefied gases are introduced into the tank from a bomb (not shown) and stored therein. The liquefied gases are made to flow down from a valve device 2 provided on the bottom and filled into cans C continuously transported by a conveyor 3. The valve device 2 has a valve seat 4 and a needle 6, fitted in a tapered portion of a valve opening 5 of the valve seat, to effect opening and closing of the valve and adjustment of an opening degree. An upper end of the needle 6 is connected to a plunger 7 of a solenoid 8 which is a means for opening and closing the valve. The plunger 7 is attracted by the operation of the solenoid 8 to open the valve. In the plunger stroke of the solenoid 8 is positioned a valve opening-degree control rod 9 for defining a stroke of the plunger 7. The opening-degree control rod 9 is controlled in its position by a pulse motor 10 to control the opening degree of the valve to follow the line speed. The amount of movement of the opening-degree control rod 9 is always detected by a potentiometer 22 which is a valve opening-degree detector.

Reference numeral 11 designates a direction changing nozzle for obliquely guiding a flow of liquefied gases flowing down from a liquefied gas flow valve. The direction changing nozzle 11 has a nozzle orifice 12 inclined in a direction of transporting the can C. The flow of liquefied gases flowing down from the flow valve flows down through the nozzle orifice 12 thereby imparting a speed component in a direction of transporting the can to relieve the shock produced when reaching a liquid level of the can C and prevent scattering of the liquefied gases outside of the can. The nozzle orifice 12 is in the shape of a V or a diamondshape which is large enough with respect to the flow amount and is converged into a single streak without diffusion of the flow liquid, and the average effect resulting from the downwardly inclined surface may be obtained. A heater 13 is provided to prevent a flow turbulence resulting from generation of frost at the nozzle orifice 12.

Figure 2:
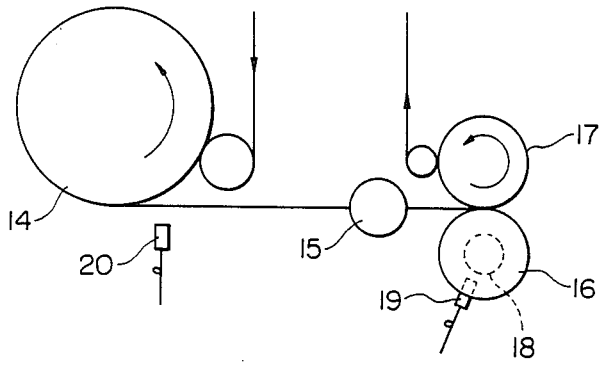
FIG. 2 shows an arrangement of a liquefied gas filling line.
Figure 4A:
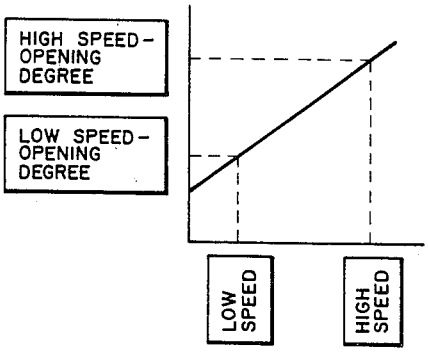
FIGS. 4 (*a*) and (*b*) are respectively explanatory views showing a method for setting a speed/opening-degree conversion graph according to the present invention.
Figure 4B:
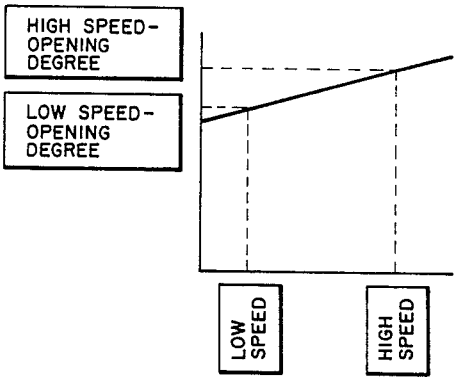

FIG. 2 shows a liquefied gas filling line to which the liquefied gas flow apparatus is applied. In FIG. 2, a filling machine 14 fills the content liquids into the can. The liquefied gas flowing apparatus is shown as numeral 15 and a seamer is shown as 17. The can is filled with the content liquid by the filling machine 14. The liquified gas is added to the head space by the liquefied gas flow apparatus 15 while being transported to the seamer 17 by means of a conveyor. A can lid is supplied to an opening by a can-lid turret 16 and the seaming of the can lid is carried out by seamer 17.

The control method for the aforementioned liquefied gas flowing apparatus will be described hereinafter.

Figure 3:
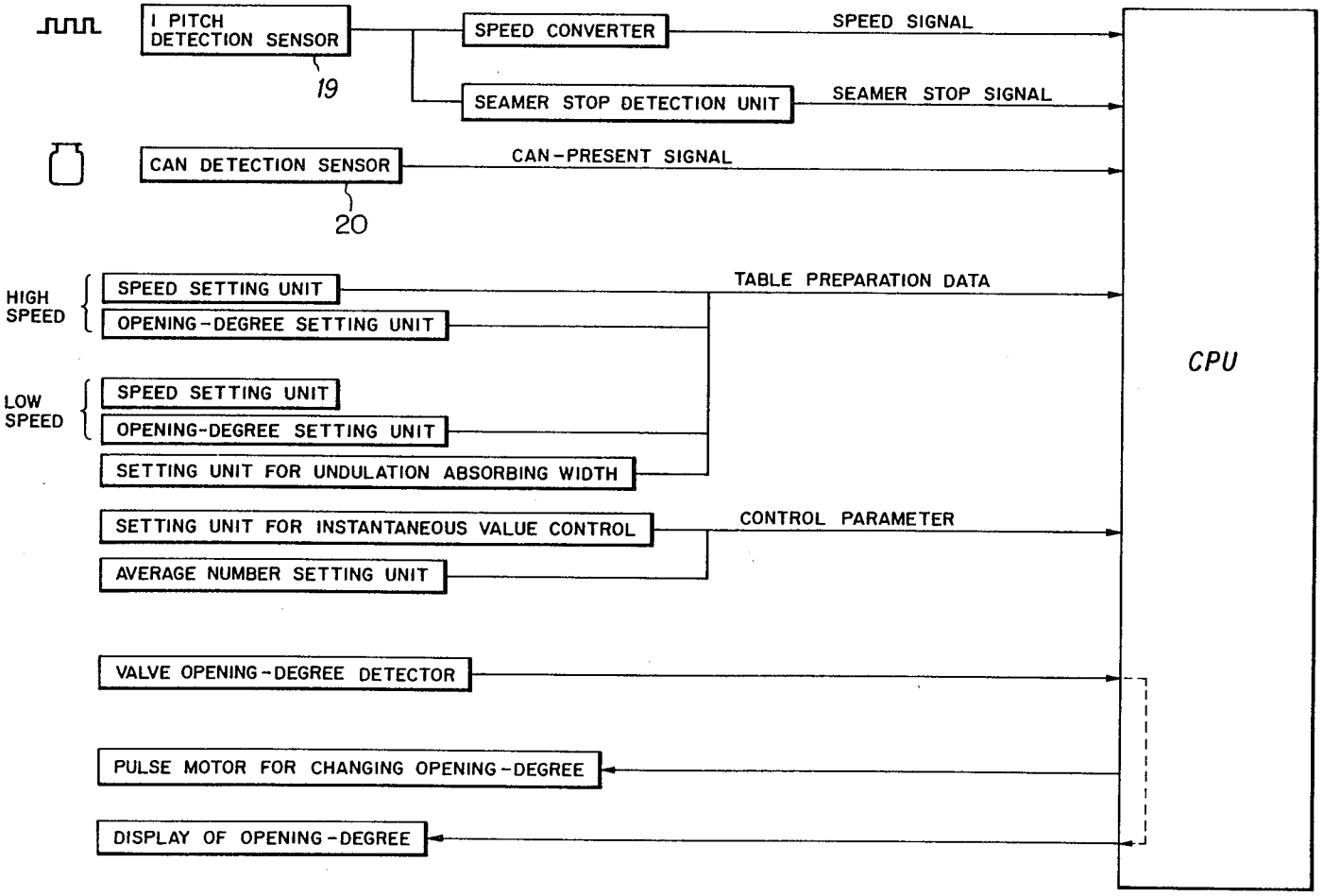
FIG. 3 is a block diagram of a control apparatus according to the present invention.

FIG. 3 is a block diagram of control apparatus. The control apparatus comprises a detection unit, a condition setting unit, a central processing unit and a control output unit. Data for conversion of a line speed to a valve opening amount and control program are stored in the central processing unit CPU.

The detection unit comprises a speed converter, a seamer stop detector, a can detection sensor 20 and a valve opening-degree detector, which are connected to an input port of the CPU. In the speed converter, a cam top of a speed detection cam 18 provided on a drive shaft of a can-lid supply turret 16, shown in FIG. 2, is detected by a speed detection sensor 19, the detection signal being converted into a line speed. The seamer stop detecting unit detects the stop of a seamer 17 by not receiving a detection signal for a fixed period of time from the speed detection sensor 19. The speed detection cam 18 is not necessarily provided on the drive shaft of the can-lid supply turret 16 but may be provided on another drive shaft. The seamer stop signal does not depend on the output of the speed detection sensor 19 but an operating signal for the seamer 17 may be introduced from a seamer control panel.

Figure 6:
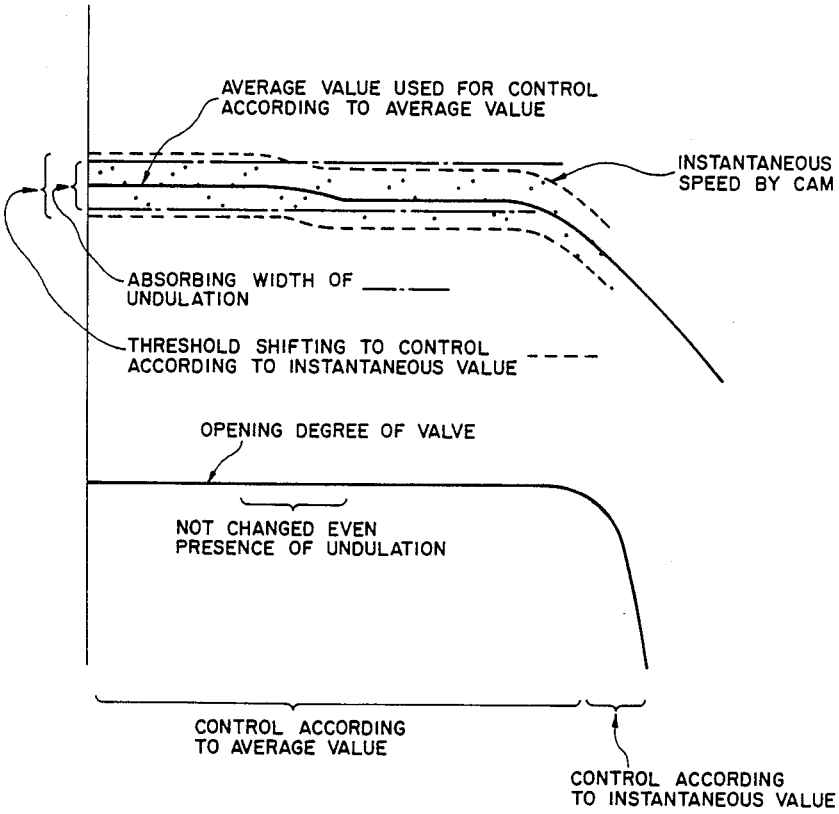
FIG. 6 is a graph showing the relationship between the line speed and the opening degree of the valve.

The condition setting unit comprises a table preparation data setting unit comprising a speed setting unit and an opening-degree setting unit for high speed, a speed setting unit and an opening-degree setting unit for low speed, and setting unit for an undulation absorbing width, and a control parameter setting unit comprising an instantaneous value control and setting unit and an average number setting unit. The condition setting unit is connected to an input port of the CPU. The line speed always varies finely due to variations of the load of the seamer 17, and the like, as shown in FIG. 6, and also has a long periodic undulation. The measured value always varies due to an error in construction of a cam top of the speed detection cam 18 and the like. When the opening degree of the valve is controlled accurately to follow the fine variation in speed a deterioration in the service life of a potentiometer 22 of the opening-degree detector and the opening-degree adjusting means occurs. However, it has been proven from experiments conducted by the present inventor that if variation in measuring speed is within a fixed range, a problem will not occur even if the opening degree of the valve is not accurately followed. In view of the aforesaid fact, in the present embodiment, the opening degree of the valve is made constant with respect to the speed variation within a fixed range so as to protect the valve opening-degree detector and the valve opening-degree setting means. The aforementioned setting unit for an instantaneous value control and the average number setting unit are provided to set the control parameter therefor. Since the error in the cam top can be absorbed by taking an average with integer times of the number of tops of a cam, control can be effected at the speed of the average value. However, if control with an average value is always effected, the followability when the seamer 17 is varied in speed is insufficient. It is therefore designed so that when a difference between the average speed and the instantaneous speed exceeds a fixed value, the opening degree of the valve is made to be varied for each can. The aforementioned instantaneous value control and setting unit is provided to set a threshold in the variation range when shifting to control an instantaneous value. The average number setting unit is provided to set the average number used in control of the average value.

On the other hand, the setting unit for undulation absorbing width is provided to set the range by making an opening of a fixed portion constant in a high speed region of a speed/opening degree conversion table to absorb the undulation of a seamer speed.

Figure 5:
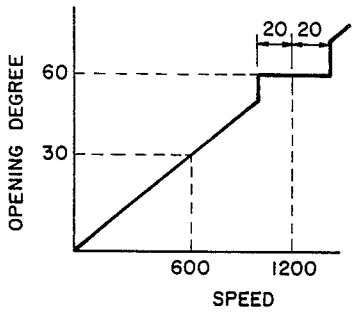
FIG. 5 is a speed/opening-degree conversion graph showing an example for setting an undulation absorbing width according to the present invention.

Influence of variation in measuring speed on variation in valve opening-degree is greater at the time of high speed. For example, in case of 600 cpm (cans per minute), if the number of pulses passing through a can is 500 pulses, the number of pulses passing through a can at a high speed of 1200 cpm is 200 pulses. Accordingly, in the case where variation by one pulse is present, at the time of low speed, variation is 1/500 whereas at the time of high speed, it is 1/250. At the time of high speed, even for a minute variation, the control of the valve opening-degree immediately responds. However, in the high speed region, even if the valve opening degree is made constant with respect to variation in speed in the fixed range, variation in internal pressure of the can, can be ignored. For example, as shown in FIG. 5, where a can has a standard internal pressure, 1.8 $Kg/cm^2$, a value of 1200 cpm$\pm$20 cpm is set to be constant. Thus, the internal pressure at 1180 cpm is 1.85 $Kg/cm^2$ and the internal pressure at 1220 cpm is 1.75 $Kg/cm^2$. The difference therebetween is merely 0.05 $Kg/cm^2$, which is an amount that may be ignored when compared with an unevenness $\pm$0.5 $Kg/cm^2$ of the internal pressure in general filling of liquid nitrogen. On the basis of the aforementioned knowledge, the present invention has intended to prolong the service life of the valve opening-degree control apparatus by making the opening degree constant in a fixed range of the high speed region of the speed/opening-degree conversion table as shown in FIG. 5. The aforesaid fixed range can be set under the optimum condition by making suitable presetting possible. The relationship between the line speed and the valve opening-degree according to the aforementioned control method is shown in FIG. 6.

The control output unit comprises a pulse motor 10 for changing an opening degree and an opening-degree indicator. The control output unit is connected to an output port of the CPU.

Control of flowing of liquefied gases in the apparatus for filling liquefied gases organized as described above is carried out as follows:

In the case where the line speed is high, such as 1200 cpm, a fixed line speed is set by a speed setting unit for high speed, and an amount of the valve opening-degree at the speed is set by an opening-degree setting unit in consideration of the filling condition or the like. The undulation absorbing width at the speed region is set by the setting unit for an undulation absorbing width and input into the CPU. In the CPU, a speed/valve opening conversion table is prepared on the basis of these inputs. In the case where the line speed is in a region of low speed, such as 600 cpm, table preparing data is input by the speed setting unit and opening-degree setting unit for low speed.

Next, as a control parameter, a difference between the average speed and instantaneous speed shifting to control an instantaneous value is input to the setting unit for an instantaneous value control, and an average number used for control of an average value is input to the average value setting unit and input into the CPU.

In this manner, when the condition setting unit is provided and a program is started, a pulse is generated every detection of a cam top by the speed detection sensor 19, and the pulse width is counted by a short pulse produced by the speed converter to thereby convert it into a line speed which is read in the CPU. At that time, when the speed detection sensor 19 does not produce pulses for a predetermine period of time, a seamer stop signal is input from the seamer stop detection unit, as a consequence of which the valve is closed. Accordingly, when the seamer stops, due to the occurrence of jamming, in the state wherein a can is present, the flow of the liquefied gases momentarily stops, thus preventing a waste of the liquefied gases and occurrence of defective cans. It is noted that the seamer stop signal can be directly input from the control panel for the seamer.

A speed detection signal is read whereby a valve opening-degree is arithmetically determined based upon the line speed/valve opening-degree conversion table. A control signal is output to the pulse motor 10 for changing an opening-degree compared with a signal from the valve opening-degree detector to control a position of the opening degree control rod 9 and set the valve opening-degree. When a can-present signal is provided from the can detection sensor 20, the solenoid 8 is actuated to immediately open the valve. Since the valve opening and closing means and the valve opening-degree adjusting means are dependently provided so as to independently control the valve opening degree, accurate valve opening-degree can be obtained even in the early stage of operation.

Figure 7:
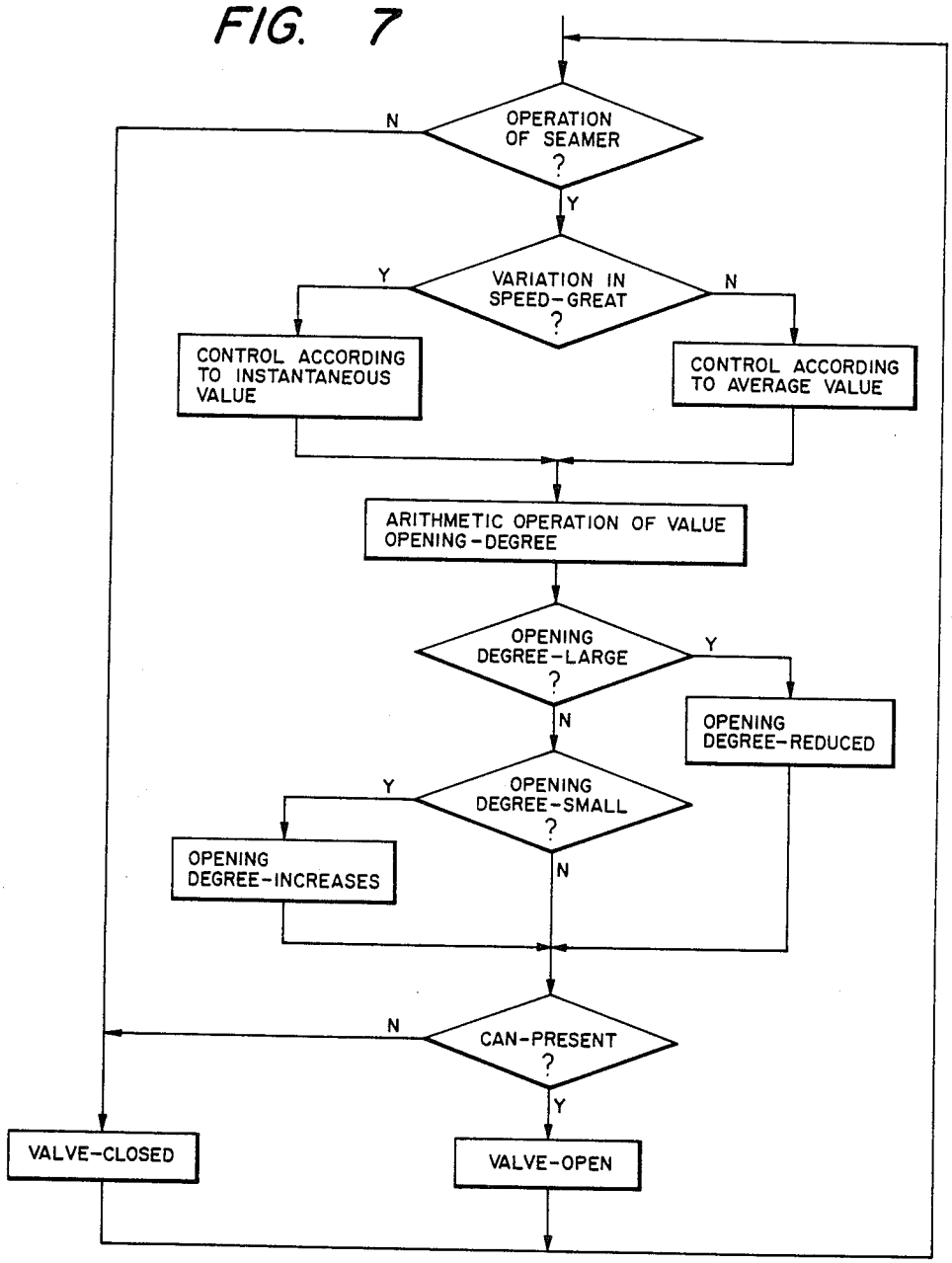
FIG. 7 is a flow chart of an embodiment according to the present invention.

The above-described control flow is shown in a flow chart in FIG. 7.

As described above, the valve opening-degree is controlled to follow the speed of the line, and the liquefied gases flows down from the valve. The liquefied gases from the valve is applied with a speed component in a direction of transporting a can by the direction changing nozzle 11 and filled into cans moving thereunder. The speed component in a direction of transporting a can is applied to the flow of liquefied gases to thereby relieve the shock produced when reaching a liquid level in the can. Scattering of liquid can be satisfactorily prevented without the provision of a porous tray in the midst portion as in prior art. Since the tray is not provided, the change in the valve opening-degree directly serves as the change in the filling amount in the can, thus providing the high speed followability when the valve opening-degree is changed.

What is claimed is:

1. An apparatus for flowing liquefied gases from a liquefied gas storage tank for filling liquefied gases into cans, on a conveyor system, immediately before seaming of said cans, said apparatus comprising:

a valve device including a valve opening, formed in a bottom surface of a liquefied gas storage tank, and a needle fitted into said valve opening;

a valve device actuating solenoid having a plunger connected to an upper portion of said needle, said valve device actuating solenoid moving said needle upward and downward by attracting or releasing said plunger to open and close said valve opening;

a valve control rod which defines a stroke of said plunger;

a pulse motor for moving upward and downward said valve control rod to adjust an opening amount of said valve device;

a valve opening-degree detection means for detecting a position of said valve control rod to detect an opening degree of the valve device;

a line speed detector for detecting a line speed of said cans on a conveyor system and for generating a line speed signal; and a control device for controlling an opening-degree of said valve device in response to said line speed signal from said line speed detector, said control device including a central processing unit, and high and low speed setting units and high and low valve opening-degree setting units in a paired relation for operating in a high line speed region and a low line speed region, said speed and valve opening-degree setting units inputting to said central processing unit a line speed/valve opening-degree conversion table for determining a valve opening-degree with respect to the line speed in a relationship which varies according to whether the line speed is in said high line speed region or said low line speed region, wherein based upon said conversion table input by said speed setting units and said valve opening-degree setting units, an opening amount of said valve device is calculated by said central processing unit from a detected value of said line speed from said line speed detector, and said central processing unit compares a calculated opening amount with a detected value of said valve opening-degree detected by said valve opening-degree detection means, and said central processing unit inputting a drive signal to said pulse motor until said calculated value and said detected value coincide.

2. An apparatus for flowing liquefied gases from a liquefied gas storage tank for filling liquefied gas into cans, on a conveyor, immediately before seaming of said cans, said apparatus comprising:

a valve device including a valve opening, formed in a bottom surface of a liquefied gas storage tank, and a needle fitted into said valve opening;

a valve device actuating solenoid having a plunger connected to an upper portion of said needle, said valve device actuating solenoid moving said needle upward and downward by attracting or releasing said plunger to open and close said valve opening;

a valve control rod which defines a stroke of said plunger;

a pulse motor for moving upward and downward said valve control rod to adjust an opening amount of said valve device;

a valve opening-degree detection means for detecting a position of said valve control rod to detect an opening degree of the valve device;

a line speed detector for detecting a line speed of said cans on a conveyor and for generating a line speed signal; and a control device for controlling an opening-degree of said valve device in response to said line speed signal from said line speed detector, said control device including a central processing unit, high and low speed setting units and high and low valve opening-degree setting units in a paired relation for operating in a high line speed region and a low line speed region, said speed setting units inputting to said valve opening-degree setting units inputting to the central processing unit a line speed/valve opening-degree conversion table for determining a valve opening-degree with respect to the line speed in a relationship which varies according to whether the line speed is in said high line speed region or said low line speed region, p2 an instantaneous value control setting unit inputting to said central processing unit a speed variation range for controlling the opening degree of the valve device in response to an instantaneous speed of the line speed detected by said line speed detector, and an average number setting unit inputting to the central processing unit an average line speed in which an opening degree of the valve device is constant with respect to a variation in line speed within a given range of line speeds; and wherein aid control processing unit compares said line speed detected by said line speed detector with said average line speed of said average number setting unit, and an amount of opening degree of said valve device is calculated by said central processing unit based upon said conversion table of said speed setting unit and said valve opening-degree setting unit from a line speed set by either (a) said average number setting units, if a difference between said line speed and said average line speed is within said speed variation range set by said instantaneous value setting unit or (b) a detected value of line speed from said line speed detector, if a difference is outside the speed variation range, said central processing unit comparing said calculated value within the detected value of the valve opening-degree detected by said valve opening-degree detection means, and said central processing unit inputting a drive signal to said pulse motor until said calculated value and said detected value coincide.

* * * * *